US011605500B2

(12) United States Patent
Winter et al.

(10) Patent No.: US 11,605,500 B2
(45) Date of Patent: Mar. 14, 2023

(54) TRANSFORMER CORE AND TRANSFORMER

(71) Applicant: Robert Bosch GmbH, Stuttgart (DE)

(72) Inventors: Christian Winter, Ludwigsburg (DE); Jan Riedel, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 261 days.

(21) Appl. No.: 16/956,891

(22) PCT Filed: Nov. 23, 2018

(86) PCT No.: PCT/EP2018/082389
§ 371 (c)(1),
(2) Date: Jun. 22, 2020

(87) PCT Pub. No.: WO2019/120882
PCT Pub. Date: Jun. 27, 2019

(65) Prior Publication Data

US 2021/0065969 A1 Mar. 4, 2021

(30) Foreign Application Priority Data

Dec. 20, 2017 (DE) ..... 10 2017 223 322.2

(51) Int. Cl.

| | |
|---|---|
| ***H01F 27/38*** | (2006.01) |
| ***H01F 3/14*** | (2006.01) |
| ***H01F 27/24*** | (2006.01) |
| ***H01F 38/08*** | (2006.01) |

(52) U.S. Cl.
CPC ..... *H01F 27/38* (2013.01); *H01F 3/14* (2013.01); *H01F 27/24* (2013.01); *H01F 38/08* (2013.01)

(58) Field of Classification Search
CPC . H01F 27/38; H01F 3/14; H01F 27/24; H01F 38/08
See application file for complete search history.

(56) References Cited

U.S. PATENT DOCUMENTS

| | | | | |
|---|---|---|---|---|
| 1,815,842 A * | 7/1931 | Gay | ..... | H02J 3/04 307/18 |
| 3,657,678 A | 4/1972 | Schwenden | | |
| 4,350,934 A * | 9/1982 | Spreadbury | ..... | H05B 41/18 315/282 |

(Continued)

FOREIGN PATENT DOCUMENTS

| | | |
|---|---|---|
| CN | 106469602 A | 3/2017 |
| DE | 3917850 | 12/1989 |

(Continued)

OTHER PUBLICATIONS

International Search Report for Application No. PCT/EP2018/082389 dated Feb. 21, 2019 (English Translation, 2 pages).

*Primary Examiner* — Rafael O De Leon Domenech
(74) *Attorney, Agent, or Firm* — Michael Best & Friedrich LLP

(57) ABSTRACT

The invention relates to a transformer core with at least one additional leg. Said additional leg is used to form a leakage path. In order to optimize the installation space and for easier connection of the transformer windings, the transformer legs and the additional leakage path legs are not arranged along a common line.

9 Claims, 3 Drawing Sheets

(56) References Cited

U.S. PATENT DOCUMENTS

| | | | | |
|---|---|---|---|---|
| 4,902,942 | A * | 2/1990 | El-Hamamsy | H01F 29/14 315/276 |
| 6,100,783 | A * | 8/2000 | Hopkinson | H01F 27/245 336/216 |
| 6,683,524 | B1 * | 1/2004 | Hoglund | H01F 27/25 336/215 |
| 6,980,077 | B1 | 12/2005 | Chandrasekaran et al. | |
| 2003/0090355 | A1 * | 5/2003 | Hoglund | H01F 41/0213 336/213 |
| 2005/0024179 | A1 | 2/2005 | Chandrasekaran et al. | |
| 2006/0125591 | A1 | 6/2006 | Yang et al. | |
| 2008/0012676 | A1 | 1/2008 | Suzuki | |
| 2015/0270051 | A1 * | 9/2015 | Grubl | H01F 7/06 336/212 |
| 2019/0263369 | A1 | 8/2019 | Miyata et al. | |

FOREIGN PATENT DOCUMENTS

| | | | |
|---|---|---|---|
| EP | 03355298 | | 2/1990 |
| EP | 3211646 | | 8/2017 |
| GB | 1542445 | A | 3/1979 |
| JP | S53143926 | A | 12/1978 |
| JP | S6081630 | U | 6/1985 |
| JP | 2016051873 | A | 4/2016 |

* cited by examiner

TRANSFORMER CORE AND TRANSFORMER

BACKGROUND OF THE INVENTION

The present invention relates to a transformer core and to a transformer with a transformer core of this type.

Power electronic DC converters can utilize transformers if an adaptation of the input voltage to the output voltage or ensuring of a galvanic isolation is necessary. Here, a high longitudinal inductance in series with the transformer can be desired in a manner which is dependent on the selected topology. Said longitudinal inductance can be realized, for example, as an external inductance, or else can be integrated into the transformer as a leakage inductance. In order to limit an increase in size of the transformer as a result of the integration of the leakage inductance, additional flux leakage can be conducted in a material with a high magnetic permeability in the transformer.

Document EP 0 355 298 A2 discloses a switching power supply with a transformer with an air gap. In particular, the air gap can be divided into a plurality of part air gaps by way of the insertion of small ferrite plates into the air gap, with the result that the spatial extent of the magnetic leakage field is reduced.

SUMMARY OF THE INVENTION

Accordingly, the following is provided:

A transformer core with a first transformer leg, a second transformer leg and a leakage path leg. The first transformer leg has a first longitudinal axis. The second transformer leg has a second longitudinal axis. The leakage path leg has a further longitudinal axis. Furthermore, a first plane is predefined which runs through the first longitudinal axis and the second longitudinal axis. Here, the leakage path leg is arranged in such a way that the longitudinal axis of the leakage path leg is situated outside the first plane which is defined by the first longitudinal axis and the second longitudinal axis.

Furthermore, the following is provided:

A transformer with a transformer core according to the invention and a first winding which is arranged on the first transformer leg, and a second winding which is arranged on the second transformer leg.

The present invention is based on the finding that the longitudinal or leakage inductance of the transformer can be increased by way of the use of additional leakage path legs in a transformer core. An increase of this type of the longitudinal or leakage inductance of the transformer can be desirable depending on the circuitry topology, in which a transformer of this type is to be used. Here, however, the additional leakage path legs of the transformer core lead to an increase of the installation space. In particular, the additional leakage path legs make the connection of the primary and secondary windings to a transformer of this type difficult.

The present invention is therefore based on the concept of taking into account said finding and of providing an efficient geometry for a transformer core with additional leakage path legs, which geometry, furthermore, enables as efficient an installation as possible of a transformer core of this type. Moreover, it is an aim of the present invention to provide a geometry for a transformer core with additional leakage path legs, which geometry enables as comfortable a connection as possible of the primary and secondary winding of the transformer.

To this end, the present invention provides that the legs of the transformer which receive the primary and secondary winding and the additional leakage path legs are not arranged in a linear structure. Rather, the additional leakage path legs are arranged away from a line which is formed by way of the transformer legs for the primary and secondary winding. By way of a "displacement" of this type of the leakage path legs in relation to the transformer legs, a transformer core geometry can be produced which firstly enables as efficient an installation as possible of transformers of this type and, moreover, also makes the connection of the primary and secondary windings of the transformer accessible in as satisfactory a manner as possible, without said connections being blocked or impeded by way of a leakage path leg.

The term "transformer leg" is to be understood to mean that part of the transformer core which is surrounded by a winding, for example the primary winding or the secondary winding of the transformer. As a rule, the individual transformer legs, in particular the legs of the primary winding and the secondary winding, run at least approximately parallel to one another. The leakage path leg is a further part of the transformer core which as a rule likewise runs at least approximately parallel to the transformer legs. In contrast to the transformer legs, however, no winding is usually arranged on said leakage path leg. Rather, the leakage path leg serves primarily to increase the leakage inductance of the transformer.

The legs of the transformer core, that is to say the transformer legs and leakage path legs, can be connected to one another in each case via suitable transformer yokes. To this end, any desired suitable geometries are fundamentally possible, as will be described in greater detail in the following text. In particular, a plurality of transformer legs and possibly leakage path legs and at least part of the transformer yokes can also be formed jointly from a material or material composite. As an alternative, it is also possible for the individual transformer legs, leakage path legs and yokes to be configured in each case as individual components and to be connected to one another or fixed on one another by way of suitable further fastening possibilities.

The structure according to the invention of the transformer core therefore achieves an improved, space-optimized integration capability of the transformer in circuits. Here, the connector points of the transformer, in particular the connector points of the primary and secondary winding, are readily accessible, with the result that long connector paths and associated unutilized areas are not required. This reduces the installation space which is required and, moreover, also the electric resistances which occur.

In accordance with one embodiment, the transformer core comprises a first transformer yoke and a second transformer yoke. Here, the first transformer leg, the second transformer leg and the leakage path leg are arranged between the first transformer yoke and the second transformer yoke. A self-contained transformer core structure is produced in this way. In this case, however, the term "contained" expressly also comprises possibly required air gaps for setting the inductances in the transformer. As has already been described above, the transformer legs are to be understood here to mean those parts of the transformer, on which the windings are arranged, in particular the primary and secondary winding. The leakage path leg corresponds to a further component which is arranged in the same way as the transformer legs, but without an additional winding being arranged on the leakage path leg. The individual legs of the transformer core, that is to say the transformer legs and the leakage path leg, are connected to one another via the first and second transformer yoke. Here, in particular, the legs can in each case have end faces, the two yokes being arranged in each case on the end faces of the legs. Here, the connections and fixings of the transformer legs, leakage path leg and yokes can take place by means of any desired suitable apparatuses, holders, etc.

In accordance with one embodiment, the first transformer yoke, the first transformer leg, the second transformer leg and the leakage path leg are of contiguous configuration. Depending on the embodiment, however, it is also possible for any desired combination of the required components of the transformer core to be in each case of contiguous configuration. For example, the leakage path leg can also be of contiguous configuration with a yoke, whereas the first and the second transformer leg are of contiguous configuration with the respective other yoke.

In accordance with one embodiment, an air gap is arranged at least between the first and/or the second transformer yoke and the leakage path leg. In this way, the leakage inductance in the magnetic path can be increased through the yoke and the leakage path leg. A suitable filling material which fills the air gap completely or partially can possibly be introduced into the air gap.

In accordance with one embodiment, the leakage path leg comprises ferromagnetic powder grains. The inductance can likewise be increased by way of the use of ferromagnetic powder grains. Configurations of this type with ferromagnetic powder grains are also known under the term of distributed air gaps.

In accordance with one embodiment, a second plane can be defined by way of the longitudinal axes of the second transformer leg and the leakage path leg. In particular, the leakage path leg can be arranged in such a way that the second plane runs perpendicularly here with respect to the first plane which is defined by way of the longitudinal axes of the first and second transformer leg.

In accordance with one embodiment, the transformer core comprises a plurality of leakage path legs, each leakage path leg in each case having an individual longitudinal axis. In particular, the plurality of leakage path legs can be arranged in such a way that all the longitudinal axes of the leakage path legs are situated outside the first plane which is formed by way of the first longitudinal axis and the second longitudinal axis of the first transformer leg and the second transformer leg. In this way, the required leakage inductance can be formed through a plurality of leakage path legs. As a result, the individual leakage path legs can be of particularly small and efficient configuration, with the result that the required installation space can possibly be decreased further.

In accordance with one embodiment, a plane can be defined by way of the longitudinal axes of at least two leakage path legs, which plane runs parallel to the first plane which is defined by the first and the second longitudinal axis of the first transformer leg and the second transformer leg. In this way, the first transformer leg and the second transformer leg can be arranged in a line which runs parallel to a line which is formed by way of two leakage path legs. This makes a particularly compact and efficient construction of the transformer core with leakage path legs possible.

In accordance with one embodiment, at least two leakage path legs can be arranged in such a way that the longitudinal axes of the two leakage path legs define a plane which runs perpendicularly with respect to the first plane which is defined by the first longitudinal axis of the first transformer leg and the second longitudinal axis of the second transformer leg. This configuration makes an arrangement of the leakage path legs possible on both sides of the line which is formed by way of the first transformer leg and the second transformer leg.

The above refinements and developments can be combined with one another in any desired way, insofar as this is appropriate. Further refinements, developments and implementations of the invention also comprise combinations which are not mentioned explicitly of features of the invention which are described above or will be described in the following text with regard to the exemplary embodiments. Here, in particular, a person skilled in the art will also add individual aspects as improvements or additions to the respective basic forms of the invention.

BRIEF DESCRIPTION OF THE DRAWINGS

Further features and advantages of the present invention will be described in the following text on the basis of the figures, in which.

DETAILED DESCRIPTION

Figure 1:
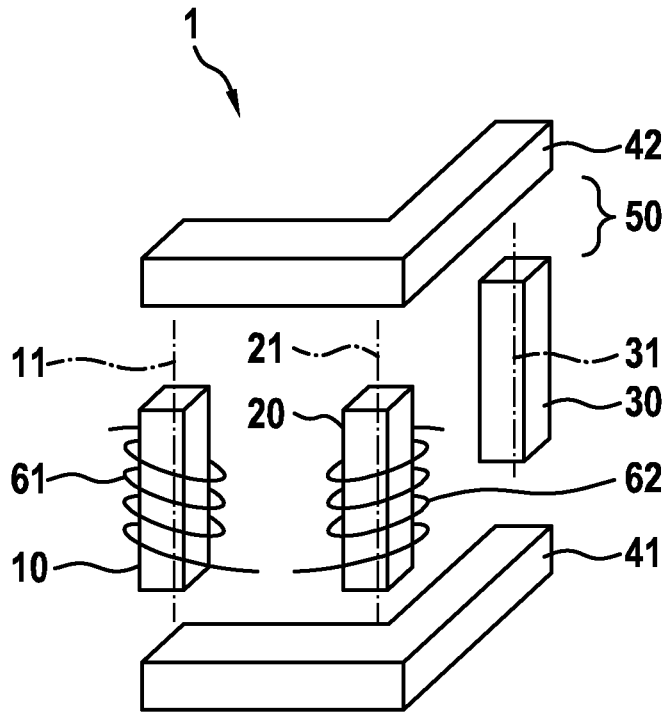
FIG. 1 shows a perspective view of a transformer core in accordance with one embodiment.

FIG. 1 shows a diagrammatic illustration of a perspective view of a transformer core 1 in accordance with one embodiment. The transformer core comprises a first transformer leg 10, a second transformer leg 20, a leakage path leg 30, and a first yoke 41 and a second yoke 42. As can be seen, the first transformer leg 10, the second transformer leg 20 and the leakage path leg 30 are arranged between the first transformer yoke 41 and the second transformer yoke 42. In particular, the upper end faces of the first transformer leg 10, the second transformer leg 20 and the leakage path leg 30 point in the direction of the upper, second transformer yoke 42. The lower end faces of the first transformer leg 10, the second transformer leg 20 and the leakage path leg 30 point in the direction of the lower, first transformer yoke 41.

Here, the first transformer leg 10 has a longitudinal axis 11. Said longitudinal axis 11 can be, for example, an axis of symmetry which runs from the upper end face as far as the lower end face of the first transformer leg 10. Any desired other longitudinal axes, in particular longitudinal axes between the upper and the lower end face of the first transformer leg 10, are fundamentally possible, however. In an analogous manner, the second transformer leg 20 has a second longitudinal axis 21 which runs between the upper and the lower end face of the second transformer leg 20. The leakage path leg 30 likewise has a further longitudinal axis 31 which runs between the upper and the lower end face of the leakage path leg 30.

In the case of the embodiment shown here according to FIG. 1, the first transformer leg 10, the second transformer leg 20 and the leakage path leg 30 in each case have an at least approximately square cross section perpendicularly with respect to the respective longitudinal axes. The present invention is not restricted, however, to square cross sections of this type. Rather, any desired shapes for the cross sections of the transformer legs 10, 20 and the leakage path leg 30 are possible. For example, rectangular, circular, oval or other cross sections are also possible.

Here, the longitudinal axis 11 of the first transformer leg 10, the second longitudinal axis 21 of the second transformer leg 20 and the further longitudinal axis 31 of the leakage path leg 30 do not lie in a common alignment. In other words, the first longitudinal axis 11 of the first transformer leg 10 and the second longitudinal axis 21 of the second transformer leg 22 lie in a virtual plane, and the longitudinal axis 31 of the leakage path leg 30 lies here outside said virtual plane which is defined by way of the longitudinal axes 11, 21 of the first and second transformer legs 10, 20. In this way, an angled-away structure (here, for example, an L-shaped structure) is formed by way of the structure of the transformer core 1.

In order to configure a transformer with the transformer core structure 1 which is shown here, for example, a first winding 61, for example a primary winding, can be arranged on the first transformer leg 10, and a second winding 62, for example a secondary winding, can be arranged on the second transformer leg 20. In this way, an inductive transmission of energy is possible between the winding on the first transformer leg 10 and the winding on the second transformer leg 20. A gap, for example an air gap 50, can be provided, in particular, on the leakage path leg 30 in order to adapt and set the leakage inductance of the transformer with the structure shown here of the transformer core 1. For example, said air gap 50 can be situated between the leakage path leg 30 and the upper, second transformer yoke 42. Moreover, however, any other desired positions of the air gap 50 in the region of the leakage path leg 30 are also fundamentally possible. In particular, the leakage inductance of the transformer can be adapted and varied by way of variation and adaptation of the dimensions of the air gap 50.

Figure 2:
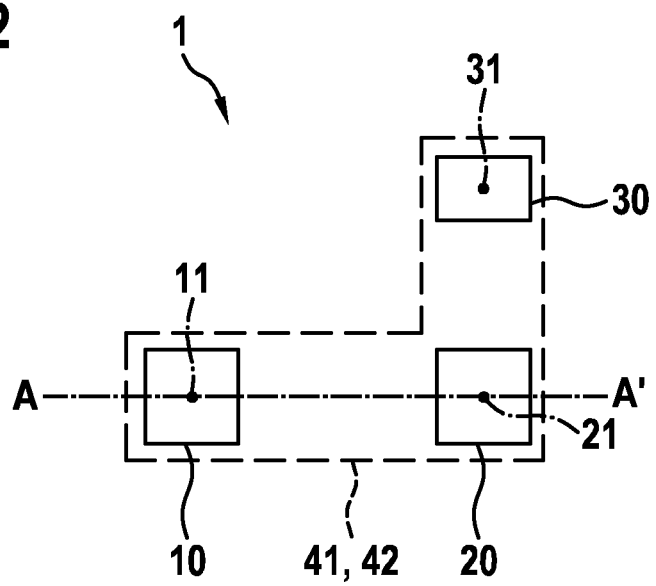
FIGS. 2 to 6 show diagrammatic illustrations of cross sections through transformer cores in accordance with embodiments of the present invention.

FIG. 2 shows a diagrammatic illustration of a cross section through a transformer with a transformer core 1 in accordance with one embodiment. Here, the first and second transformer yoke 41, 42 from FIG. 1 are shown using dashed lines. A plane is defined by way of the first longitudinal axis 11 of the first transformer leg 10 and the second longitudinal axis 21 of the second transformer leg 20, which plane is shown in the cross section according to FIG. 2 by way of A-A'. Here, the longitudinal axis 31 of the leakage path leg 30 is situated away from said plane A-A'. For example, a further plane can be defined by way of the second longitudinal axis 21 of the second transformer leg 20 and the longitudinal axis 31 of the leakage path leg 30, which further plane is shown in the cross section according to FIG. 2 by way of B-B'. In particular, the planes according to A-A' and the plane according to B-B' can intersect at a right angle or at least approximately at a right angle.

A first winding, in particular a primary winding of a transformer, can be provided, for example, on the first transformer leg 10, and a further winding, in particular a secondary winding of a transformer, can be provided, for example, on the second transformer leg 20. Here, on account of the angled-away geometry of the structure for the transformer core 1, the connections of the primary winding and the secondary winding are particularly readily accessible.

Figure 3:
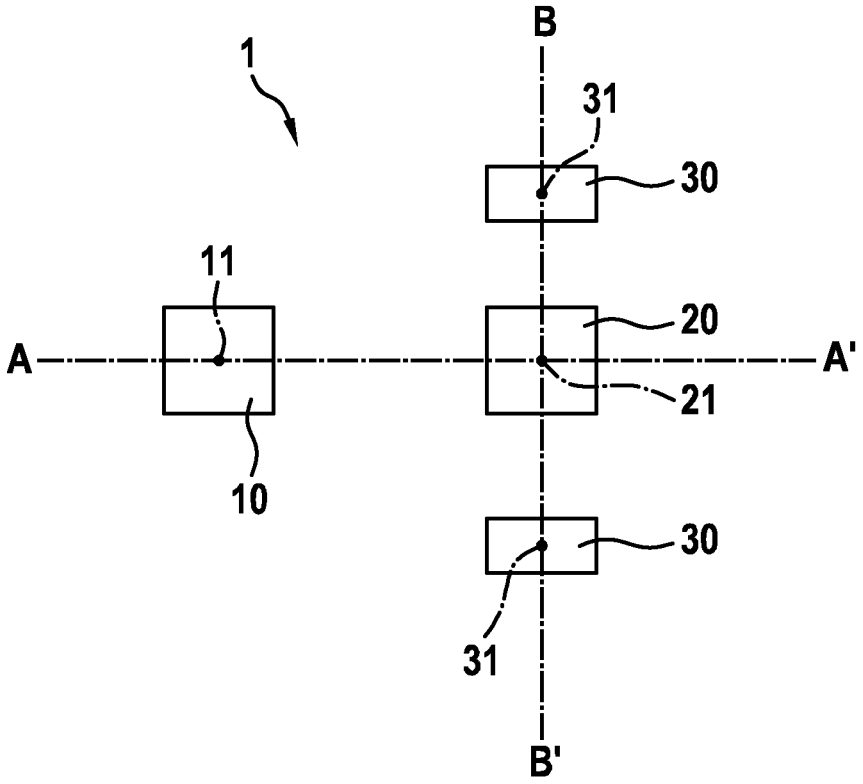

FIG. 3 shows a diagrammatic illustration of a cross section through a transformer core 1 in accordance with a further embodiment. Said embodiment differs from the above-described embodiment according to FIG. 2 in that, in this case, the transformer core 1 has two leakage path legs 30. The two leakage path legs 30 in each case have a longitudinal axis 31 which lies outside the plane A-A' which is defined by way of the first longitudinal axis 11 of the first transformer leg 10 and the second longitudinal axis 21 of the second transformer leg 20. In the embodiment which is shown here, the two longitudinal axes 31 of the leakage path legs 30 and the longitudinal axis 21 of the second transformer leg 20 lie in a common plane B-B'. This is to be understood, however, merely as an exemplary embodiment. Moreover, the transformer core 1 can also have any desired other configuration, in the case of which the longitudinal axes 31 of the leakage path legs 30 lie outside the plane A-A' which is defined by way of the first longitudinal axis 11 of the first transformer leg 10 and the second longitudinal axis 21 of the second transformer leg 20.

Figure 4:
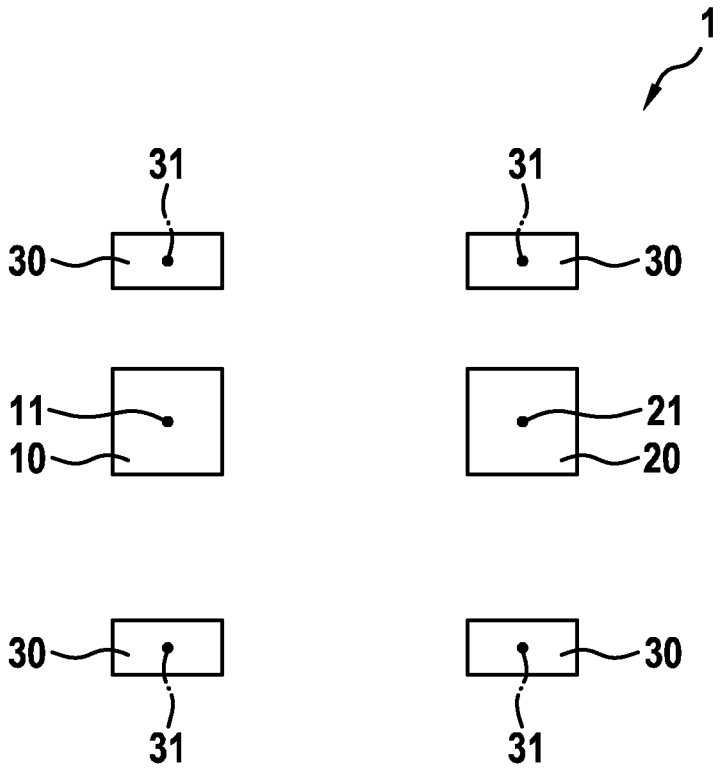

FIG. 4 shows a diagrammatic illustration of a further embodiment of a transformer core 1. In said embodiment, the transformer core 1 comprises four leakage path legs 30 with in each case one longitudinal axis 31. Here, the four leakage path legs 31 are arranged, for example, along a rectangle or square at the outer corners of the structure which is formed by way of the transformer core 1.

Figure 5:
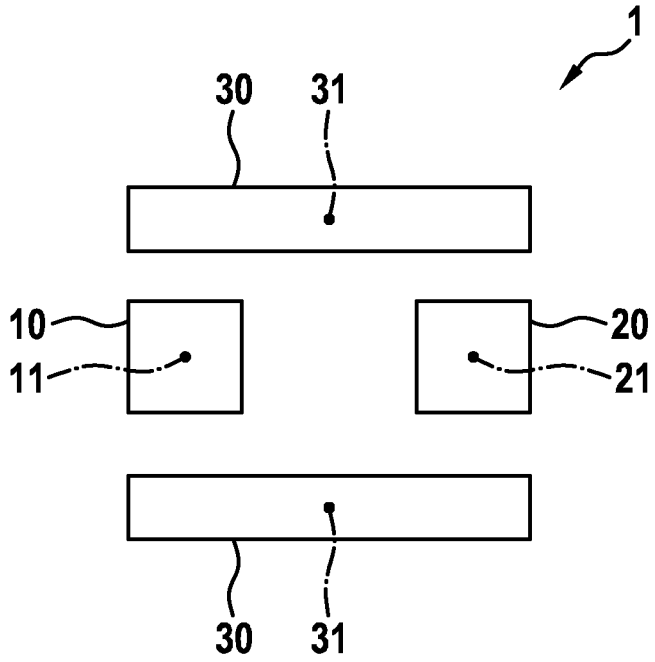

FIG. 5 shows a diagrammatic illustration of a further embodiment for a transformer core 1. Here, the transformer core 1 has an elongate leakage path leg 30 which extends parallel to the plane A-A' which is defined by way of the first longitudinal axis 11 of the first transformer leg 10 and the second longitudinal axis 21 of the second transformer leg 20, over the dimensions between the first transformer leg 10 and the second transformer leg 20. For example, a corresponding leakage path leg 30 can be provided on each side of the plane A-A'. Moreover, it is also possible, however, for only one leakage path leg 30 to be provided on one side, which leakage path leg 30 extends over the entire length between the first transformer leg 30 and the second transformer leg 20.

Figure 6:
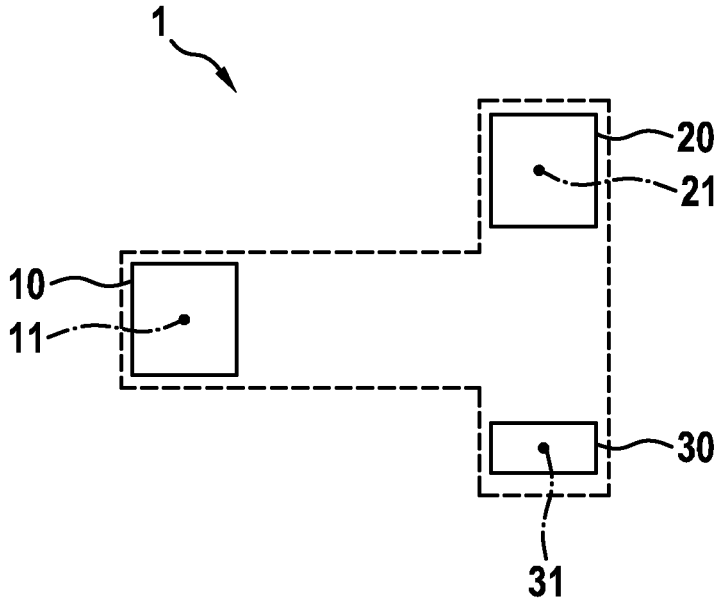

Finally, FIG. 6 shows a further embodiment of a transformer core 1 with a leakage path leg 30. As shown here, the transformer core 1 does not necessarily have to have a square, right-angled or L-shaped structure with a right angle. It is fundamentally possible for the transformer core 1 according to the invention to provide at least one leakage path leg 30, the longitudinal axis 31 of which is situated away from the area which is defined by way of the longitudinal axes 11, 21 of the two transformer legs 10, 20.

Any desired materials which are fundamentally suitable for the production of transformer cores are possible as material for the transformer legs 10, 20, the transformer yokes 41, 42 and the leakage path leg or legs 30. In particular, the individual legs and yokes can also be realized from laminations or lamination bundles. Here, a plurality of the components of transformer legs 10, 20, leakage path legs 30 and transformer yokes 41, 42 can also form a common module. For example, all of the components can be configured as a common module, with the exception of the first, upper transformer yoke 42. Moreover, it is also possible, for example, for the leakage path yoke or yokes 30 and the first transformer yoke 41 to be configured as a common module, and for the first and the second transformer legs 10, 20 and the second transformer yoke 42 to likewise be configured as a common module. Moreover, it goes without saying that any other desired combinations of components of the above-described transformer core 1 as a common structural element are also possible.

As has already been described above, a gap 50, in particular an air gap, can be provided between the leakage path leg 30 and the first transformer yoke 41 and/or the second transformer yoke 42. Any desired suitable filling materials can also possibly be embedded into said air gap.

Furthermore, it is also possible for the leakage path leg or legs 30 to be configured as a leakage path leg with a distributed air gap, that is to say for the leakage path leg to be configured from a material with ferromagnetic powder grains.

In summary, the present invention relates to a transformer core with at least one additional leg. Said additional leg serves to configure a leakage path. In order to optimize the installation space and for easier connection of the transformer windings, the transformer legs and the additional leakage path leg are not arranged along a common line.

The invention claimed is:

1. A transformer with a transformer core (1), the transformer comprising:

a first transformer leg (10) which has a first longitudinal axis (11);

a second transformer leg (20) which has a second longitudinal axis (21);

a first leakage path leg (30) which has a third longitudinal axis (31) a second leakage path leg (30) which has a fourth longitudinal axis (31);

wherein the third longitudinal axis (31) and the fourth longitudinal axis (31) are each situated outside a first plane (A-A') which is defined by the first longitudinal axis (11) and the second longitudinal axis (21) and wherein the third longitudinal axis (31) and the fourth longitudinal axis (31) define a second plane which runs parallel to the first plane (A-A'), a primary winding (61) disposed on the first transformer leg (10); and a secondary winding (62) disposed on the second transformer leg (20), wherein no winding is disposed on the first and second leakage path legs (30).

2. The transformer as claimed in claim 1, with:

a first transformer yoke (41); and a second transformer yoke (42), the first transformer leg (10), the second transformer leg (20), the first leakage path leg (30), and the second leakage path leg (30) being arranged between the first transformer yoke (41) and the second transformer yoke (42).

3. The transformer as claimed in claim 2, the first transformer yoke (41), the first transformer leg (10), the second transformer leg (20), the first leakage path leg (30), and the second leakage path leg (30) being of contiguous configuration.

4. The transformer as claimed in claim 2, an air gap (50) being arranged between the second transformer yoke (42) and one of the first and second leakage path legs (30).

5. The transformer as claimed in claim 1, one of the first and second leakage path legs (30) comprising ferromagnetic powder grains.

6. The transformer as claimed in claim 5, wherein each of the first and second leakage path legs (30) comprises ferromagnetic powder grains.

7. The transformer as claimed in claim 1, further comprising a third leakage path leg (30) which has a fifth longitudinal axis (31), and a fourth leakage path leg (30) which has a sixth longitudinal axis (31).

8. The transformer as claimed in claim 7, wherein the fifth longitudinal axis (31) and the sixth longitudinal axis (31) define a third plane which runs parallel to the first plane (A-A').

9. The transformer as claimed in claim 8, wherein the first plane (A-A') is positioned between the second plane and the third plane.

* * * * *